US005649882A

United States Patent [19]

Parikh et al.

[11] Patent Number: 5,649,882

[45] Date of Patent: Jul. 22, 1997

[54] EXERCISE TREADMILL

[75] Inventors: Ashok N. Parikh, Cedar Rapids, Iowa; Weston L. Cutter, Mendota Heights, Minn.

[73] Assignee: Universal Gym Equipment, Inc., Cedar Rapids, Iowa

[21] Appl. No.: 544,818

[22] Filed: Oct. 18, 1995

[51] Int. Cl.[6] ..... A63B 22/02

[52] U.S. Cl. ..... 482/54; 482/51

[58] Field of Search ..... 482/54, 51

[56] References Cited

U.S. PATENT DOCUMENTS

| | | | |
|---|---|---|---|
| 3,689,066 | 9/1972 | Hagen . | |
| 3,994,261 | 11/1976 | Wedell et al. . | |
| 4,334,676 | 6/1982 | Schönenberger . | |
| 4,350,336 | 9/1982 | Hanford . | |
| 4,614,337 | 9/1986 | Schönenberger . | |
| 4,819,583 | 4/1989 | Guerra . | |
| 5,072,928 | 12/1991 | Stearns et al. | 482/54 |
| 5,081,991 | 1/1992 | Chance . | |
| 5,279,528 | 1/1994 | Dalebout et al. . | |
| 5,336,144 | 8/1994 | Rodden . | |
| 5,382,207 | 1/1995 | Skowronski et al. . | |

FOREIGN PATENT DOCUMENTS

| | | |
|---|---|---|
| 0 504 649 A1 | 9/1992 | European Pat. Off. . |
| 2 616 132-A1 | 6/1987 | France . |
| 1347953 A2 | 10/1987 | U.S.S.R. . |

*Primary Examiner*—Lynne A. Reichard
*Attorney, Agent, or Firm*—Merchant, Gould, Smith, Edell, Welter & Schmidt, P.A.

[57] ABSTRACT

An exercise treadmill has a plurality of shock absorbing springs which are disposed between a tread supporting subframe and a floor engaging frame. The springs are inserted into vertically oriented sleeves which are secured to the floor engaging frame. Posts extend downward from the subframe and into the sleeves and ride on the tops of the springs.

15 Claims, 2 Drawing Sheets

EXERCISE TREADMILL

FIELD OF THE INVENTION

The present invention relates to exercise equipment and more particularly, to an exercise treadmill having shock absorbing springs disposed between a floor engaging frame and a tread supporting subframe.

BACKGROUND OF THE INVENTION

Soviet Union Author Certificate No. 1,347,953 discloses an exercise treadmill having helical coil springs disposed between a floor engaging frame and a tread supporting subframe. The treadmill also has leaf springs to further absorb impact transmitted through the subframe, and levers to prevent horizontal movement of the subframe relative to the frame.

U.S. Pat. No. 5,336,144 discloses an exercise treadmill having elastomeric springs disposed between a floor engaging frame and a tread supporting subframe. Studs project downward from the subframe, through the elastomeric springs, and into apertures in the frame, to prevent horizontal movement of the subframe relative to the frame.

U.S. Pat. No. 5,081,991 discloses an exercise treadmill (for horses) having elastomeric isolation mounts disposed between a floor engaging frame and a tread supporting subframe.

U.S. Pat. No. 5,382,207 discloses an exercise treadmill having elastomeric springs disposed between a floor engaging frame and a tread supporting subframe.

U.S. Pat. No. 5,279,528 discloses an exercise treadmill having elastomeric strips disposed between a floor engaging frame and a tread supporting subframe and/or an inflatable bladder disposed between the frame and the floor.

The foregoing patents indicate that those skilled in the art are familiar with the provision of shock absorbing means on exercise treadmills. However, it is believed that room for additional advances and new embodiments remains. Accordingly, an object of the present invention is to provide a new and improved treadmill support system which is effective and reliable in use.

SUMMARY OF THE INVENTION

The present invention provides an exercise treadmill having a tread supporting subframe supported by springs relative to a floor engaging frame. Posts on the subframe extend downward into sleeves in the floor engaging frame and ride on top of the springs. The springs absorb impact caused by a person walking or running on the treadmill. The sliding relationship between the posts and the sleeves allows vertical movement between the subframe and the frame, but prevents horizontal movement therebetween. Advantages of the present invention will become apparent upon the more detailed description of the invention that follows.

BRIEF DESCRIPTION OF THE FIGURES OF THE DRAWINGS

With reference to the Figures of the Drawing, wherein like numerals represent like parts and assemblies throughout the several views.

DETAILED DESCRIPTION OF THE PREFERRED EMBODIMENT

Figure 1:
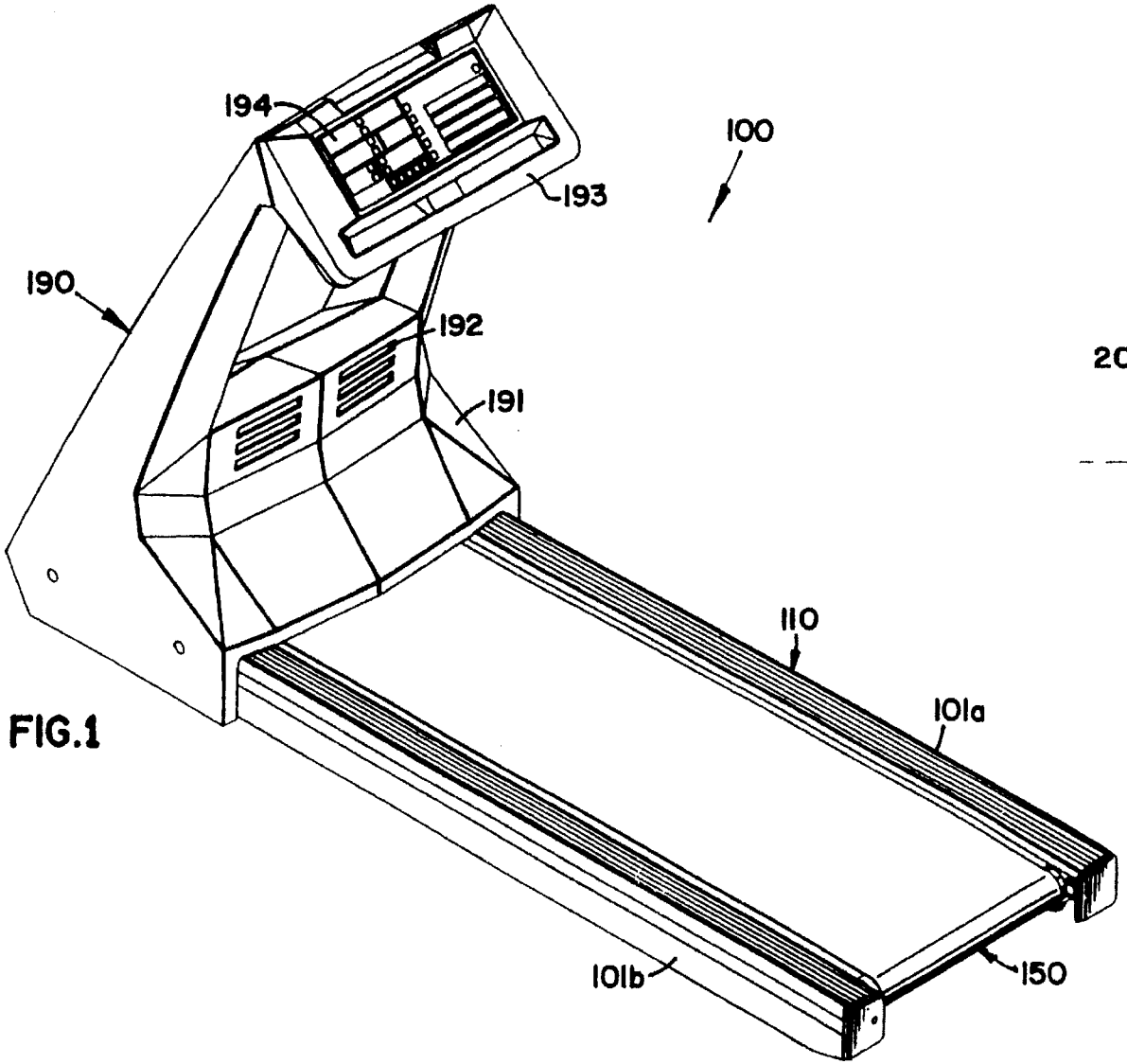
FIG. 1 is an isometric view of a preferred embodiment exercise treadmill constructed according to the principles of the present invention.

A preferred embodiment exercise apparatus constructed according to the principles of the present invention is designated as 100 in FIG. 1. The apparatus 100 generally includes a floor engaging frame 110, a continuous tread 150 rotatably mounted to the frame 110, a tread supporting subframe 130 disposed within the tread 150 and movably mounted on the frame 110, and a console 190 secured to a forward end of the frame 110 and extending upward therefrom.

Figure 2:
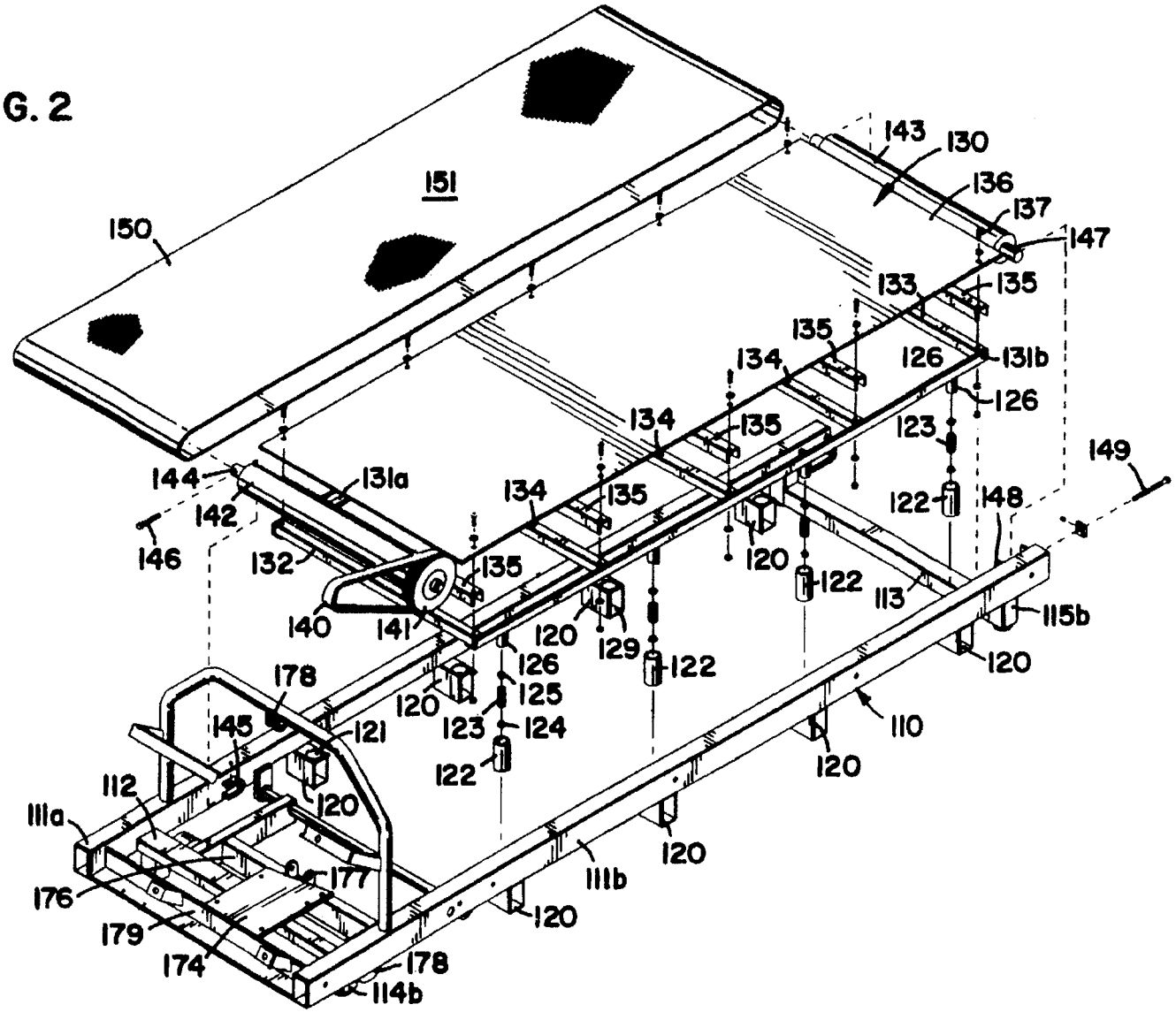
FIG. 2 is an exploded isometric view of a lower portion of the exercise treadmill shown in FIG. 1.

The frame 110 includes a pair of side rails 111*a* and 111*b* which extend parallel to one another along opposite sides of the apparatus 100. Each of the side rails 111*a* and 111*b* is a steel tube having a rectangular profile or cross-section. A front end rail 112 is interconnected between the side rails 111*a* and 111*b* proximate front ends thereof. The front end rail 112 is also a steel tube having a rectangular cross-section. A square tube segment is connected to each end of the front end rail 112 and extends downward to support the treadmill frame 110 when in a least inclined orientation relative to a floor surface. One of these tubes is designated as 114*b* in FIG. 2.

A square tube segment is connected to each side rail 111*a* and 111*b* proximate a respective rear end thereof and extends downward to support the treadmill frame 110 above the floor surface. One of these tubes is designated as 115*b* in FIG. 2. A rear end rail 113 is interconnected between these rear legs. The rear end rail 113 is also a steel tube having a rectangular cross-section. The rear end rail 113, the front end rail 112, and the side rails 111*a* and 111*b* cooperate to form a substantially rigid rectangular frame.

A plurality of steel tube segments 120, having rectangular cross-sections, are secured beneath each of the side rails 111*a* and 111*b* and extend inward, toward an opposite side rail. Cross-sections taken through the segments 120 are parallel to cross-sections taken through the front end rail 112 and the rear end rail 113. A circular hole 121 is formed through a top surface of each tube segment 120 and cooperates therewith to define upwardly opening compartments 129. The circular holes have a diameter of approximately 1.25 inches.

A cylindrical sleeve or bushing 122 is inserted into each of the upwardly opening compartments 129. The sleeves 122 have an outer diameter (approximately 1.25 inches) which is equal to the diameter of the circular holes 121. The sleeves 122 have an inner diameter (approximately 0.875 inches) which is sized to receive additional parts as discussed below. The sleeves 122 are made of nylon and intended to facilitate relatively low friction and low decibel operation of the apparatus 100.

A helical coil spring 123 is associated with each of the sleeves 122. The springs 123 have an outer diameter (approximately 0.73 inches) which is less than the inner diameter of the sleeves 122. The springs 123 have an inner diameter (approximately 0.42 inches) which is sized to receive additional parts as discussed below. The springs 123 are made of steel and sufficient in strength to support the weight and impact associated with a person who is running on the treadmill 100 for exercise. More specifically, over thirty pounds is required to cause 0.1 inches of compression of any of the springs 123.

Figure 3:
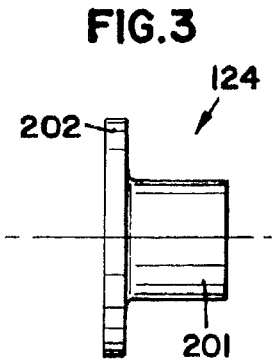
FIG. 3 is a side view of a cap which is present on the exercise treadmill shown in FIG. 1.

A pair of caps or bushings 124 and 125 is associated with each of the springs 123. As shown in FIG. 3, each of the caps 124 and 125 includes a hub portion 201 having a diameter of approximately 0.375 inches, which is less than the inner diameter of the springs 123. Each of the caps 124 and 125 also includes a radially extending rim portion 202 having a diameter of approximately 0.75 inches, which is slightly larger than the outer diameter of the springs 123. The caps 124 and 125 are made of nylon and intended to facilitate relatively low friction and low decibel operation of the apparatus 100.

The hub 201 of a lower cap 124 is inserted into a lower end of each of the springs 123, and the hub of an upper cap 125 is inserted into an upper end of each of the springs 123. The combination of two caps 124 and 125 and a spring 123 disposed therebetween, is inserted into each of the sleeves 122. The caps 124 and 125 and the sleeves 122 cooperate to effectively encase the springs 123 in plastic and thereby reduce noise associated with deflection of the springs 123.

The subframe 130 includes a pair of side rails 131*a* and 131*b* which extend parallel to one another along opposite sides of the apparatus 100. Each of the side rails 131*a* and 131*b* is a steel bar having an L-shaped profile or cross-section. A front end rail 132 is interconnected between the side rails 131*a* and 131*b* proximate front ends thereof. The front end rail 132 is a steel tube having a square cross-section. A rear end rail 133, identical to the front end rail 132, is interconnected between the side rails 131*a* and 131*b* proximate rear ends thereof. Additional, intermediate rails 134, identical to the end rails 132 and 133, are interconnected between the side rails 131*a* and 131*b* intermediate the end rails 132 and 133. The end rails 132 and 133, the intermediate rails 134, and the side rails 131*a* and 131*b* cooperate to form a substantially rigid rectangular subframe.

A neoprene member 135 is mounted on each of the end rails 132 and 133 and the intermediate rails 134. Each of the neoprene members 135 has an inverted U-shaped cross-section with a channel width (approximately 0.875 inches) slightly smaller than the width of the rails 132–134. The neoprene members 135 are of 60–70 durometer and engage the rails 132–134 by friction fit. A sheet 136 of 10 gauge steel is mounted on top of the neoprene members 135 and spans the subframe 130 to provide a bearing surface for the tread 150. Fastener combinations 137 are associated with each end of each of the rails 132–134. The fastener combinations 137 include a bolt which extends through the sheet 136, a respective rail 132–134, and a respective side rail 131*a–b*, and which mates with a nut on an opposite side thereof, to secure the components of the subframe 130 together.

A plurality of steel shafts or posts 126, having cylindrical cross-sections, are secured beneath each of the side rails 131*a* and 131*b* and extend downward, aligned with the sleeves 122. The posts 126 have a diameter (approximately 0.75 inches) which is less than the inner diameter of the sleeves 122 and equal to the diameter of the upper caps 125. A post 126 inserts into each sleeve 122 and rests on top of a respective upper cap 125. As a result, the springs 123 carry the weight of the subframe 130 and anyone (or anything) on the subframe 130. The springs 123 deflect in response to impact, as well as weight, and thereby absorb shock, as do the neoprene members 135. The subframe 130 is constrained against horizontal movement relative to the frame 110 due to the relative low tolerance between the diameter of the posts 126 and the inner diameter of the sleeves 122. In other words, the subframe 130 is free to move up and down relative to the frame 110, but forward, rearward, or laterally.

The continuous tread or belt 150 is rotatably mounted relative to the frame 110 by means of a front roller 142 and a rear roller 143, each of which is interconnected between the side rails 111*a* and 111*b*. The front roller 142 includes a shaft 144 which protrudes beyond opposite ends thereof, and relative to which the front roller 142 rotates. One end of the shaft 144 supports a pulley 141 which is connected to a motor (not shown) by means of a belt 140. The motor is mounted on a platform 174 proximate the front of the frame 110 in a manner well known in the art.

The ends of the shaft 144 are secured to the side rails by means known in the art, with brackets 145 on the side rails and fastener combinations including bolts 146. The rear roller 143 likewise includes a shaft 147 which protrudes beyond opposite ends thereof, and relative to which the rear roller 143 rotates. The ends of the shaft 147 are also secured to the side rails by means known in the art, with brackets 148 on the side rails and fastener combinations including bolts 149. The bolts 149 facilitate adjustment to the tension of the tread 150.

The tread 150 is further supported by the subframe 130, which is disposed within the tread 150 and between the rollers 142 and 143 prior to mounting on the springs 123. A person may stand, walk, or run on the upwardly facing portion 151 of the tread 150 supported by the subframe 130.

Those skilled in the art will recognize that the difficulty or challenge associated with walking or running on the tread 150 is a function of both frictional drag acting on the tread 150 and the angle of inclination of the tread 150 relative to a horizontal floor surface. The apparatus 100 includes a means for adjusting this angle of inclination in a manner well known in the art. In particular, a first end of a linear actuator (not shown) is secured to a bracket 178 rigidly secured to the frame 110, and a second, opposite end of the linear actuator is secured to a bracket 177 on a leg assembly 176 which is pivotally mounted to the frame 110. In response to a control signal, the linear actuator extends or contracts to pivot the leg assembly 176 toward or away from the floor, respectively. Wheels 178 on the leg assembly 176 engage the floor and support the front end of the frame 110.

The console 190 is secured to the front end of the frame 110 by means of bracket 179 among other things. The console 190 provides an attractive housing 191 for the motorized components of the treadmill 100. Slots 192 in the housing 191 facilitate air flow to and from these motorized components. The console 190 also provides a handle or support means 193 which is accessible to a person standing on the tread 150. The console 190 further includes a performance display device and controls 194 which may be operated to adjust the angle of inclination and/or select from among different available output options or exercise routines.

The present invention is described with reference to a preferred embodiment and a specific application, but those skilled in the art will recognize additional embodiments and applications that fall within the metes and bounds of the present invention. Accordingly, the scope of the present invention is to be limited only to the extent of the following claims.

We claim:

1. An exercise treadmill, comprising:

a frame designed to rest upon a floor surface, wherein said frame provides generally upwardly opening compartments on opposite sides thereof;

a tread formed into a continuous loop and rotatably mounted to said frame;

a subframe disposed within said continuous loop and extending beyond opposite sides thereof, wherein said subframe includes generally downwardly extending posts which align with and slidably insert into said compartments;

helical coil springs disposed in said compartments and beneath said posts, wherein said springs carry said subframe and anyone on said tread; and plastic bushings disposed between respective posts and springs, wherein said bushings include cylindrical hubs which insert into respective springs, and said bushings include radially extending rims which abut lowermost surfaces on respective posts.

2. An exercise treadmill, comprising:

a frame designed to rest upon a floor surface, wherein said frame provides generally upwardly opening compartments on opposite sides thereof;

a tread formed into a continuous loop and rotatably mounted to said frame;

a subframe disposed within said continuous loop and extending beyond opposite sides thereof, wherein said subframe includes generally downwardly extending posts which align with and slidably insert into said compartments;

helical coil springs disposed in said compartments and beneath said posts, wherein said springs carry said subframe and anyone on said tread; and plastic bushings disposed between respective springs and compartment bottoms, wherein said bushings include cylindrical hubs which insert into respective springs, and said bushings include radially extending rims which abut respective compartment bottoms.

3. An exercise treadmill according to claim 2, further comprising additional plastic bushings disposed between respective posts and springs.

4. An exercise treadmill according to claim 3, wherein said additional bushings include cylindrical hubs which insert into respective springs, and said additional bushings include radially extending rims which abut lowermost surfaces on respective posts.

5. An exercise treadmill according to claim 4, wherein all of said bushings and said additional bushings are made of nylon.

6. An exercise treadmill according to claim 4, further comprising cylindrical plastic bushings disposed within said compartments, wherein said cylindrical plastic bushings slidably receive said springs and said posts.

7. An exercise treadmill, comprising:

a frame designed to rest upon a floor surface, wherein said frame provides generally upwardly opening compartments on opposite sides thereof;

a tread formed into a continuous loop and rotatably mounted to said frame;

a subframe disposed within said continuous loop and extending beyond opposite sides thereof, wherein said subframe includes generally downwardly extending posts which align with and slidably insert into said compartments;

helical coil springs disposed in said compartments and beneath said posts, wherein said springs carry said subframe and anyone on said tread; and cylindrical plastic bushings disposed within said compartments, wherein said cylindrical plastic bushings slidably receive said springs and said posts, and wherein said cylindrical plastic bushings are made of nylon.

8. An exercise treadmill, comprising:

a frame designed to rest upon a floor surface, wherein said frame includes side rails extending along opposite sides thereof, and square tube segments welded beneath said side rails and protruding inward therefrom, toward an opposite side rail, and circular holes formed in upwardly facing surfaces of said tubes to provide generally upwardly opening compartments;

a tread formed into a continuous loop and rotatably mounted to said frame;

a subframe disposed within said continuous loop and extending beyond opposite sides thereof, wherein said subframe includes generally downwardly extending posts which align with and slidably insert into said compartments; and helical coil springs disposed in said compartments and beneath said posts, wherein said springs carry said subframe and anyone on said tread.

9. An exercise treadmill according to claim 8, further comprising plastic sleeves inserted through said holes and into said compartments, wherein said sleeves and said posts are cylindrical, and said sleeves slidably receive said springs and said posts.

10. An exercise treadmill according to claim 8, wherein said frame further includes end rails extending between and interconnecting said opposing ends of side rails.

11. An exercise treadmill, comprising:

a frame designed to rest upon a floor surface, wherein said frame provides generally upwardly opening compartments on opposite sides thereof;

a tread formed into a continuous loop and rotatably mounted to said frame;

a subframe disposed within said continuous loop and extending beyond opposite sides thereof, wherein said subframe includes generally downwardly extending posts which align with and slidably insert into said compartments, and wherein said subframe includes side rails extending along opposite sides thereof, end rails extending between and interconnecting opposing ends of said side rails, a sheet of steel substantially spanning an area defined between said side rails and said end rails, and neoprene members disposed between said sheet of steel and said end rails; and helical coil springs disposed in said compartments and beneath said posts, wherein said springs carry said subframe and anyone on said tread.

12. An exercise treadmill according to claim 11, wherein said side rails have an L-shaped cross-section, said end rails are square tubes, said neoprene members have an inverted U-shaped cross-section, and said end rails are nested beneath and within said neoprene members.

13. An exercise treadmill according to claim 11, further comprising intermediate rails extending between and interconnecting opposing intermediate portions of said side rails, and additional neoprene members disposed between said sheet and said intermediate rails.

14. An exercise treadmill, comprising:

a frame designed to rest upon a floor surface;

a tread formed into a continuous loop and rotatably mounted to said frame;

a subframe disposed within said continuous loop and extending beyond opposite sides thereof; and helical coil springs substantially encased in plastic and disposed between said frame and said subframe, wherein said springs carry said subframe and anyone on said tread, and wherein each of said springs is inserted into a separate plastic tube, and a separate plastic cap is disposed adjacent each end of each of said springs.

15. An exercise treadmill according to claim 14, wherein each said tube is inserted into a separate upwardly opening compartment on said frame, and for each said tube, a separate post extends downward from said subframe and into telescoping engagement therewith.

* * * * *